United States Patent [19]

Collins

[11] 4,429,797

[45] Feb. 7, 1984

[54] TIE CADDY

[76] Inventor: Wesley A. Collins, 18417 S. Van Ness Ave., Torrance, Calif. 90504

[21] Appl. No.: 361,292

[22] Filed: Mar. 24, 1982

[51] Int. Cl.[3] ..... A47F 5/08

[52] U.S. Cl. ..... 211/119

[58] Field of Search ..... 211/119, 113, 60 R, 211/61, 59.1, 57.1, 106

[56] References Cited

U.S. PATENT DOCUMENTS

| | | | |
|---|---|---|---|
| 1,533,805 | 4/1925 | Oliver | 211/113 X |
| 2,929,509 | 3/1960 | Van Dusen | 211/59.1 |
| 3,088,597 | 5/1963 | Ritchey | 211/119 X |
| 3,923,279 | 12/1975 | Gresley et al. | 211/119 X |

FOREIGN PATENT DOCUMENTS

| | | | |
|---|---|---|---|
| 741528 | 12/1932 | France | 211/113 |
| 1535621 | 7/1968 | France | 211/113 |
| 696665 | 9/1953 | United Kingdom | 211/119 |

*Primary Examiner*—Ramon S. Britts
*Assistant Examiner*—Blair M. Johnson
*Attorney, Agent, or Firm*—Charmasson & Holz

[57] ABSTRACT

A tie caddy is provided which may be hung from one end on a closet bar, or suspended from the other end from a wall fastener, the angles of the fastener means at each end of the rack being so as to encourage the rack to assume a substantially vertical position when suspended, and yet enable the user to lift the free end of the rack so that it assumes a substantially horizontal position, spreading the ties and rendering them easily accessible.

5 Claims, 4 Drawing Figures

TIE CADDY

BACKGROUND OF THE INVENTION

Men's neckties have long presented a real problem in the wardrobe. Many men simply hang their ties over a coat hanger, over random hooks in the closet, or drape them over any suitable projection. Some men even string their ties through the sleeve of the coat that they intend to wear them with.

Because ties universally fit any sized neck, they are generally looked upon as ideal Christmas and birthday gifts. Girlfriends give ties to boyfriends. Wives give ties to husbands. Although the donor always risks the substantial possibility that the recipient will consider the tie in bad taste, at least he is assured of one thing: the subject tie will not be the wrong size. This puts ties light years ahead of shirts as a gift item, so everyone gives them to everyone else.

Whereas this is a boon to the tie industry, it is a plague to the tie-wearing male. He cannot throw them away, because most of them were gifts, and he cannot remember who gave what. Thus he ends-up with a myriad of ties festooned all over his wardrobe, and every other available hook or protuberance.

An additional and insidious dimension of this necktie affliction lies in the fact that all neckties creep toward their longer ends, without any visible input of work or energy. Thus, when the owner comes to extract a coat hanger covered with ties from the position it occupies tightly compressed between a couple of suits or shirts, the more ambitious ties have crept to the point where the big ends extend much farther than the little ends, and they are pulled off between the hanging suits in the closet or by gravity.

For these reasons, there is a desperate need for an effective tie rack which can finally put in order the festooned array in the closet, and at last bring "tie creep" under control in a forceful and positive manner.

SUMMARY OF THE INVENTION

The instant tie rack accomplishes these ends by providing a universal rack, simply made from coated wire, which is provided at both ends with a fastener means so that it can alternatively be utilized in a closet crossbar or on a nail or screw projecting from a wall.

The rack consists of a vertical spine to which are attached spaced pairs of arms, formed by brazing cross pieces onto the central spine. The ends of the arms are bent to define U-shaped ends which return to positively engage the tie and prevent it from falling off the end of the arm. When the rack is extended generally vertically, the ties fold against one another, creating a friction that will severely retard the creeping of even the most unbalanced ties.

The attachment ends of the rack are angled to enable the user to either lift the free end so that the ties will hang spaced apart and easily removable and re-hangable.

Thus, this relatively simple device will conveniently and efficiently organize and secure ties.

DETAILED DESCRIPTION OF THE PREFERRED EMBODIMENT

Figure 1:
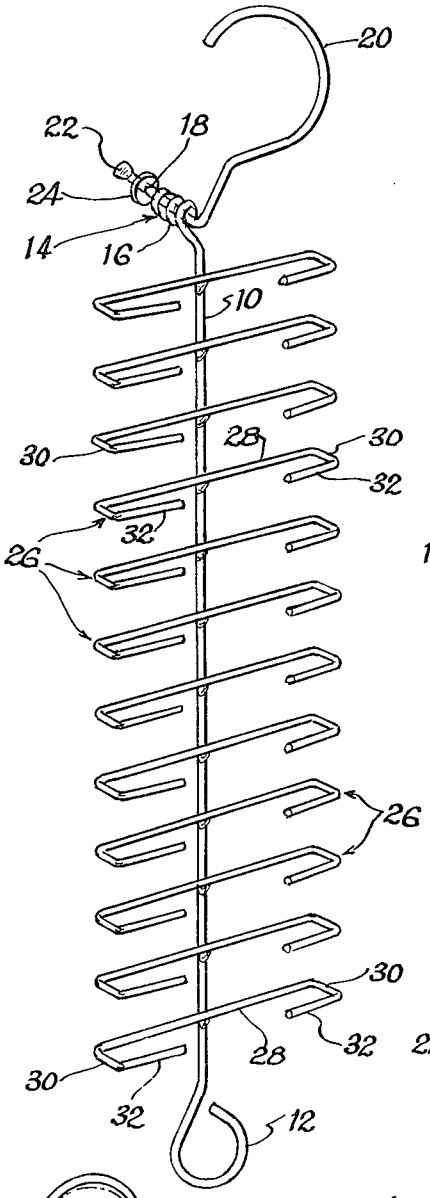
FIG. 1 is a perspective view of the rack.
Figure 2:
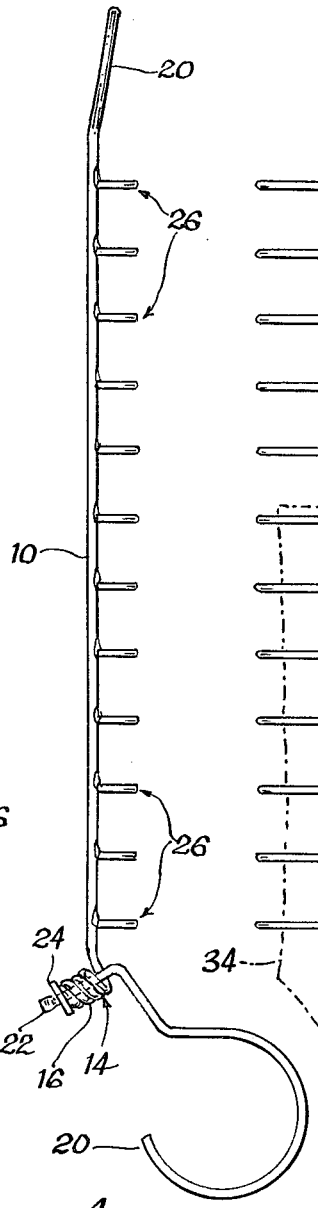
FIG. 2 is a side elevation view of the rack.

The main support member of the rack is a central spine 10 which terminates at one end and a loop 12 and in the other end in a neck 14 defined by a coiled collar 16 which captures the shaft 18 of a hanger-style hook 20. The hook is retained in the collar by a crimp 22 and a washer retainer 24. The neck 14 of course permits the hook to swivel about the axis defined by the coiled collar and the captured shaft.

At spaced intervals along the spine, a plurality of arm pairs 26 are defined, each of which has a straight horizontal segment 28, a U-bent end 30, and a return segment 32 which is parallel to the principle segment 28. The arm pairs are brazed or otherwise suitably fastened onto the spine.

Figure 3:
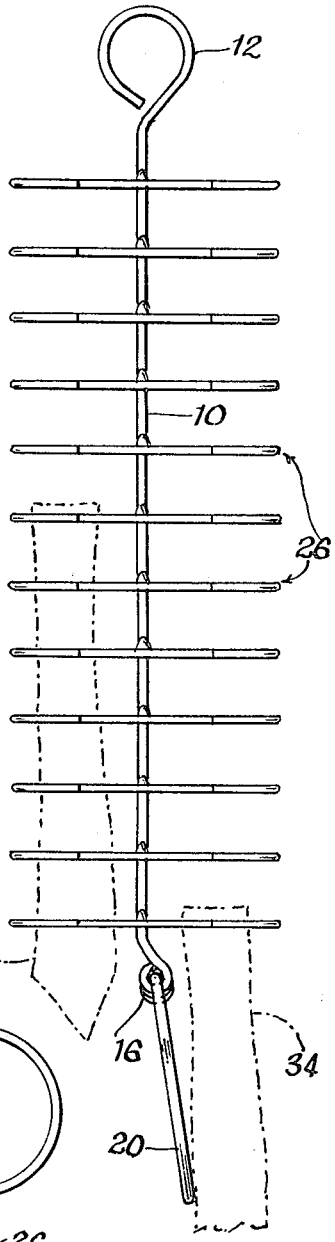
FIG. 3 is a front elevation view of the rack, inverted for hanging on a wall fastener; and, FIG. 4 illustrates the rack in its horizontally extended position, hanging at one end on a closet hanger bar.
Figure 4:
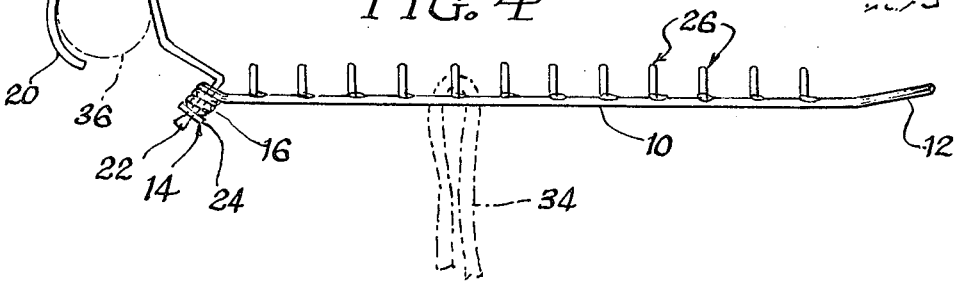

It should be noted that both the loop connector 12 and the hook 20 are angled forwardly of the plane established by the arm pairs. This enables the user to lift the free end up as shown in FIG. 4 until the body of the rack is horizontally extended as shown in FIG. 4, so that the ties 34 will automatically become spaced apart, or at least loose, compared with their compressed configuration when the rack is generally vertically extended as shown in FIG. 3. By angling the fasteners at the respective ends of the spine slightly, the effect of gravity on the fastener holds it onto the support, such as the bar 36 or a nail in the wall, rather than having a neutral or even counter-productive effect on the connector's attachment to its support beams.

Additionally, by angling the hanger hook 20 forwardly of the plane of the rack, when hung on a hanger bar 36, because the ties all extend from the back of the rack, it will have a natural tendency to angle forwardly somewhat, so that the angled connection between the hook and the spine enable the hook to hang straight while the spine angles out somewhat to accommodate the natural effects of gravity on the rack.

The swivel neck 14 generally provides more flexibility in angling the body of the rack out through relatively tightly packed clothing in a closet. Because the hook ordinarily will be maintained on the bar while ties are removed or put back on the rack, it is necessary that as much flexibility of orientation be established for the rack itself.

Thus, although very simple of construction and inexpensive to make, the instant rack is a versatile, flexible device which will hold a multiplicity of ties in a minimum of space, and yet simultaneously permit the user to expand them into a spaced array to facilitate their removal and re-hanging. By being adapted to hang either on a wall or on a closet hanger bar, every conceivable hanging situation has been taken into account, making the rack truly universal in its application.

While the preferred embodiment of the invention has been described, other modifications may be made thereto and other embodiments may be devised within the spirit of the invention and scope of the appended claims.

What is claimed is:

1. A tie-rack which comprises:

a vertical spine;

a plurality of vertically spaced lateral arm pairs extending from said spine in opposite directions from one another;

means at one end of said spine for suspending same from a fixed support, said means comprising a hook for engaging a closet clothes bar;

means for pivotally connecting said spine to said hook;

said means for connecting comprising:

said spine having a pivotal neck at said end, and said hook having a stem swivelling into said neck about an axis defining an oblique angle with said spine.

2. A tie-rack comprising:

a vertical spine;

a plurality of vertically spaced lateral arm pairs, the arms of each pair extending from said spine in opposite directions from one another;

means at one end of said spine for suspending same from a fixed support;

said means comprising a hook for engaging a closet cross-bar;

wherein said spine pivotally connects to said hook at a pivotal neck;

wherein said pivoted neck is defined by a shaft extending from said hook and a coiled collar defined in the end of said spine capturing such shaft in encircled relation.

3. Structure according to claim 2 wherein said hook, neck, spine and arms are all fabricated of coated metallic wire.

4. Structure according to claim 1 wherein said arms each defines a straight segment with a generally U-shaped returned end terminating in a length parallel to said straight segment to retain a tie on the respective arm positively.

5. Structure according to claim 1 wherein said arms are bent forwardly to define U-shaped ends and said hook angles forwardly from the spine to facilitate use of the rack.

* * * * *